US008813917B2

(12) United States Patent
Salmikuukka et al.

(10) Patent No.: US 8,813,917 B2
(45) Date of Patent: Aug. 26, 2014

(54) METHOD AND SYSTEM FOR LIMITING ACCESS RIGHTS WITHIN A BUILDING

(71) Applicants: Jukka Salmikuukka, Espoo (FI); Pertti Mäkinen, Hyvinkää (FI)

(72) Inventors: Jukka Salmikuukka, Espoo (FI); Pertti Mäkinen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/667,156

(22) Filed: Nov. 2, 2012

(65) Prior Publication Data

US 2013/0056311 A1 Mar. 7, 2013

Related U.S. Application Data

(63) Continuation of application No. PCT/FI2011/050416, filed on May 5, 2011.

(30) Foreign Application Priority Data

May 10, 2010 (FI) ..... 20100201

(51) Int. Cl.
*B66B 1/20* (2006.01)

(52) U.S. Cl.
USPC ..... 187/384; 187/391; 187/247

(58) Field of Classification Search
USPC ..... 187/247, 380–389, 391–393
See application file for complete search history.

(56) References Cited

U.S. PATENT DOCUMENTS 5,749,443 A 5/1998 Romao
6,109,396 A * 8/2000 Sirag et al. ..... 187/381
6,202,799 B1 * 3/2001 Drop ..... 187/388
6,382,363 B1 5/2002 Friedli
6,397,976 B1 * 6/2002 Hale et al. ..... 187/392
6,868,945 B2 * 3/2005 Schuster et al. ..... 187/384
7,093,693 B1 * 8/2006 Gazdzinski ..... 187/384

(Continued)

FOREIGN PATENT DOCUMENTS

CN 1976855 A 6/2007
CN 101287666 A 10/2008
WO WO-2007/026042 A2 3/2007
WO WO-2008145803 A1 12/2008

OTHER PUBLICATIONS

International Search Report PCT/ISA/210 for International Application No. PCT/FI2011/050416 dated Jun. 10, 2011.
Finnish Search Report, 2010.

(Continued)

*Primary Examiner* — Anthony Salata
(74) *Attorney, Agent, or Firm* — Harness, Dickey & Pierce, P.L.C.

(57) ABSTRACT

The present invention presents a solution for limiting access rights in a building, which building contains a conveying system, an access control system connected to the conveying system, which access control system comprises at least one short-range identification point and at least one long-range identification point and in which access control system passengers have a personal terminal device for giving service requests to the conveying system. A terminal device is taken into the operating area of a short-range identification point, the access rights connected to the service requests of the terminal device are activated, the terminal device is taken into the operating area of a long-range identification point and a service request generated with the terminal device is transmitted to the conveying system, if the access right connected to the service request is valid on the basis of the activation.

19 Claims, 2 Drawing Sheets

(56) References Cited

U.S. PATENT DOCUMENTS

Figure 1:
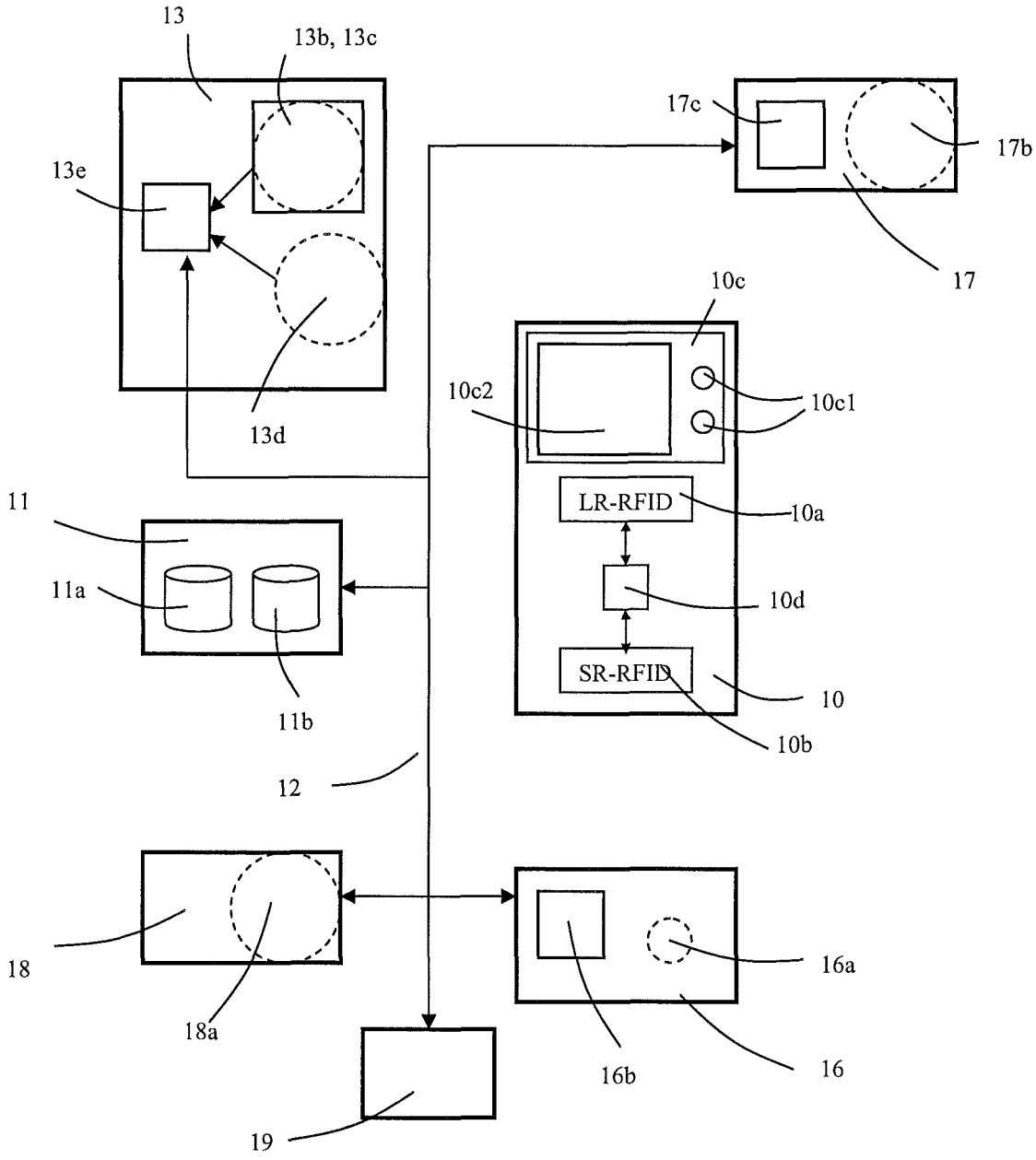

| | | | | |
|---|---|---|---|---|
| 7,353,915 | B2 * | 4/2008 | Zaharia et al. | 187/388 |
| 7,581,622 | B2 * | 9/2009 | Amano | 187/384 |
| 8,020,672 | B2 * | 9/2011 | Lin et al. | 187/392 |
| 8,061,485 | B2 * | 11/2011 | Finschi | 187/384 |
| 8,381,880 | B2 * | 2/2013 | Finschi | 187/388 |
| 8,438,021 | B2 * | 5/2013 | Liu et al. | 704/233 |
| 8,490,754 | B2 * | 7/2013 | Amano | 187/384 |
| 8,499,895 | B2 * | 8/2013 | Zweig | 187/387 |
| 2001/0022252 | A1 | 9/2001 | Schuster | |
| 2005/0138385 | A1 | 6/2005 | Friedli et al. | |
| 2008/0217112 | A1 * | 9/2008 | Puskala et al. | 187/392 |
| 2009/0020370 | A1 | 1/2009 | Boss et al. | |
| 2009/0133969 | A1 | 5/2009 | Zaharia et al. | |

OTHER PUBLICATIONS

English translation of Chinese Office Action dated Apr. 17, 2014 for corresponding Chinese Application No. 201180022918.0.

* cited by examiner

METHOD AND SYSTEM FOR LIMITING ACCESS RIGHTS WITHIN A BUILDING

CROSS REFERENCE TO RELATED APPLICATIONS

This is a continuation of PCT/FI2011/050416 filed May 5, 2011, which is an International Application claiming priority to FI 20100201 filed on May 10, 2010, the entire contents of each of which are hereby incorporated by reference.

FIELD OF THE INVENTION

The invention relates to access control. More particularly the invention relates to a method and to a system for limiting access rights in buildings, in which a passenger uses a personal terminal device for giving service requests to elevator systems and other such systems.

BACKGROUND OF THE INVENTION

With regard to elevator systems, call-giving solutions are known in which a passenger gives a destination call to the floor he/she wants by means of an identifier or terminal device in his/her possession. For reading the identifier data contained by identifiers, such as e.g. RFID identifiers (Radio Frequency Identifier), an elevator system is provided with reader devices, into the operating area of which a passenger takes his/her identifier. On the basis of the identifier data the elevator system determines the destination floor of the passenger and allocates an elevator car for the use of the passenger for traveling to the destination floor in question. In prior-art solutions, in which a passenger gives destination calls with a terminal device, e.g. with a mobile phone, elevator lobbies are provided with base stations based on e.g. Bluetooth technology for implementing data transfer between a terminal device of the passenger and the elevator system. When a passenger arrives in an elevator lobby, the base station in the elevator lobby detects a terminal device of the passenger and receives information from the terminal device, on the basis of which information the elevator system allocates an elevator car for taking the passenger to the destination floor he/she wants. Often access control is also connected to the aforementioned prior-art solutions such that for each passenger a personal service profile is determined for the elevator system or for a special access control system, in which service profile data about those floors to which the passenger has an access right is recorded.

A number of problems are, however, connected to the prior-art solutions described above. Identifiers that are to be read from close range require the identifier to be brought to the reading device or at least essentially close to it, which slows down and hampers the giving of service requests. A security risk, on the other hand, is attached to long-range identifiers/terminal devices because it is possible to spy on the communications traffic between an identifier/terminal device and a base station and to hijack data that gives access to a certain floor or space in the building. The access control systems of buildings are often centralized systems, to which all the apparatuses participating in access control are connected, making the access control system a complex and expensive solution. Access control solutions according to prior-art are also difficult to configure and to maintain and they are also inflexible, especially when it is desired for the access rights of a passenger to be temporary or otherwise dynamic without, however, compromising the reliability or other security aspects of access control.

AIM OF THE INVENTION

The aim of the present invention is to eliminate or at least to alleviate the aforementioned drawbacks that occur in prior-art solutions. The aim of the invention is also to achieve one or more of the following objectives:

- a solution applicable to access control, which solution is simple, user-friendly and easy to maintain,
- to reduce the risk of access rights being "hijacked",
- a system, which monitors the movement of passengers in a building, for detecting misuses, for guiding passengers and also for collecting statistics about traffic flows,
- to enable an elevator system in which conventional call-giving appliances based on pushbuttons are not necessarily needed.

SUMMARY OF THE INVENTION

At least one example embodiment relates to a method and/or a system for limiting access rights. Some example inventive embodiments are presented in the descriptive section and in the drawings of the present application. The inventive content in the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for limiting access rights in a building, which comprises a conveying system and an access control system connected to the conveying system, which access control system comprises at least one short-range identification point and at least one long-range identification point and in which method a personal terminal device is given into the possession of passengers, for generating service requests to the conveying system. According to the invention the terminal device is taken into the operating area of a short-range identification point, where the access rights connected to the service requests of the terminal device are activated. After it the terminal device is taken into the operating area of a long-range identification point, where a service request generated with the terminal device of a passenger is received, which service request is transmitted to the conveying system, if the access right connected to the service request is valid on the basis of the aforementioned activation.

For activating access rights, at least one of the following procedures is performed:

- a service profile is recorded in a terminal device, in which service profile the access rights connected to the service requests of the terminal device are set. With this procedure the functions of the terminal device are configured, including locations to which the possessor of a terminal device has an access right and, if necessary, the period of validity of the access right;
- the access rights recorded in a terminal device are updated by adding and/or deleting individual access rights;
- the periods of validity connected to the access rights are updated. With this procedure temporary access rights can be activated, which rights must be renewed (re-activated) from time to time, e.g. daily.

the locking of a conveying device in connection with a short-range identification point is opened, if the access right required by the procedure is valid. Opening a locking in this context means any control procedure whatsoever, which permits the access of a passenger to an area that is served by a conveying device and that is within the scope of access control. A conveying device is e.g. an outer door of a building, in connection with which an aforementioned short-range identification point is and via which a passenger is admitted into the building. When the passenger has been admitted into the building, he/she can use his/her terminal device for giving service requests within the scope of the access rights valid at the time.

A conveying system comprises at least one conveying device, such as e.g. an elevator, an elevator system, an escalator, a travelator, an automatic door or a pass gate. A service request is e.g. an elevator call, a request to open an automatic door or pass gate, or some other corresponding service request connected to the conveying system. A short-range identifier is e.g. a short-range RFID identifier (SR-RFID, short range RFID), for reading the data contained in which a passenger must take a terminal device into the operating area of a short-range identification point. The reading distance is in this case essentially short, preferably at most a few centimeters. A long-range identifier is e.g. a long-range RFID (LR-RFID, long range RFID), reading of the data contained in which can occur from a distance, preferably of a number of meters, in which case the passenger does not necessarily need to take his/her terminal device out but instead the information can be read e.g. from a terminal device in a pocket. Identification points can be in the elevator lobbies, elevator cars and information points of a building, in connection with doors, escalators and ID cards in a building, in parking halls and/or in other spaces of a building in which passengers using a conveying system move.

The present invention also discloses a system for limiting access rights in a building. The system comprises: a conveying system; an access control system connected to the conveying system, which access control system comprises at least one short-range identification point and at least one long-range identification point; and at least one terminal device given for personal use, which is provided with at least one short-range identifier and at least one long-range identifier. The access control system is arranged to activate the access rights connected to the service requests of the aforementioned terminal device in the operating area of a short-range identification point and also to transmit with the aforementioned terminal device the service request generated in the operating area of a long-range identification point to the conveying system, if the access right connected to the service request is valid on the basis of the aforementioned activation.

In one embodiment of the invention the access rights of a terminal device are activated for specific short-range identification points. As a result of the embodiment, the access rights of a passenger can be activated in different ways depending on the short-range identification point that the passenger uses for activating the access rights. For example, if there are a number of entrances in a building, the access rights of a terminal device can be activated on the basis of the entrance via which the passenger arrives in the building.

In one embodiment of the invention the terminal device is provided with a user interface, which is configured on the basis of the access rights of a terminal device. The user interface comprises a display element for presenting information connected to service requests and/or selection pushbuttons for making selections connected to service requests. As a result of the embodiment, access control can be improved and at the same time travel can be facilitated by configuring the user interface e.g. such that only service requests according to activated access rights can be given with a terminal device. A user interface can also be configured on the basis of the operating area of which identification point the terminal device is at the time. In this embodiment only those functions which are connected to the identification point to be monitored and/or to a conveying device in connection with it are available in a user interface. For example, if the identification point is in connection with an elevator system, only elevator calls to those floors to which a passenger has a valid access right can be generated with a terminal device.

In one embodiment of the invention the position of a terminal device in the building is monitored by means of the identification points and guidance data and/or alarm data is generated, if on the basis of the monitoring the terminal device deviates from the route required by the service request. As a result of the embodiment access control and the guidance of a passenger can be improved by detecting e.g. the exit of a passenger from an elevator car on a floor to which he/she is not traveling on the basis of the call he/she gave.

In one embodiment of the invention control data about terminal devices is collected in identification points. If inconsistencies are detected in the control data, an alarm is generated and/or a control procedure connected to the conveying system is performed. As a result of the embodiment access control can be improved by detecting e.g. "copied" terminal devices automatically and by preventing the access of unauthorized persons to locations within the scope of the access control.

In one embodiment of the invention exit of terminal devices from a set monitoring area is monitored in at least one identification point. If an exit of a terminal device is detected, at least a part of the usage rights of the terminal device are passivated. As a result of the embodiment access control improves because the passivated usage rights of a terminal device must be re-activated if the terminal device is e.g. taken out of the building. Since a terminal device does not in this case contain data about access rights outside the building, said access rights cannot either be copied outside the building.

In one embodiment of the invention an access right connected to a service request and the period of validity of said right are checked in the identification point in the operating area of which the terminal device is. As a result of the embodiment the identification points connected to conveying devices can independently check the validity of access rights without being connected to a centralized access control system, in which case the access control system becomes simple and can easily be maintained.

In one embodiment of the invention the conveying system comprises an elevator system, which does not comprise call-giving appliances implemented with conventional pushbuttons but instead calls are given using just a personal terminal device. As a result of the embodiment, the elevator system becomes simpler and at the same time access control becomes more efficient, because a passenger must have a terminal device, the access rights of which must be valid, in order for him/her to be able to use the conveying services of the elevator system.

With the solution according to the invention numerous advantages are achieved compared to prior-art solutions. The solution according to the invention is user-friendly, in which solution the giving of service requests can occur at a distance from conveying devices without taking a terminal device to a reader device that receives service requests. The fact that a terminal device can automatically generate service requests when the terminal device is e.g. in the pocket of a passenger also facilitates travel. Travel is further facilitated by the fact that the user interface of a terminal device can be configured on the basis of access rights, in which case it is easy for a passenger to give service requests for which he/she has a currently valid permit (access right). Also the other functions of a terminal device can be personalized, which also enhances user-friendliness. The solution according to the invention is also a cost-effective and simple solution applicable to access control, because the information about valid access rights is recorded in a terminal device, in which case a centralized access control system, from which access rights would be repeatedly checked, is not necessary. The solution according to the invention also improves access control, because access rights can be activated before entering a building and removed when leaving the building. The fact that the movements of passengers can be checked and an alarm generated if possible misuses of terminal devices are detected further improves access control. Also other advantages that can be achieved with the solution according to the invention are presented above in connection with the different embodiments.

LIST OF FIGURES

In the following, the invention will be described in detail by the aid of examples of its embodiments, wherein:

FIG. 1 presents one system according to the invention, and

Figure 2:
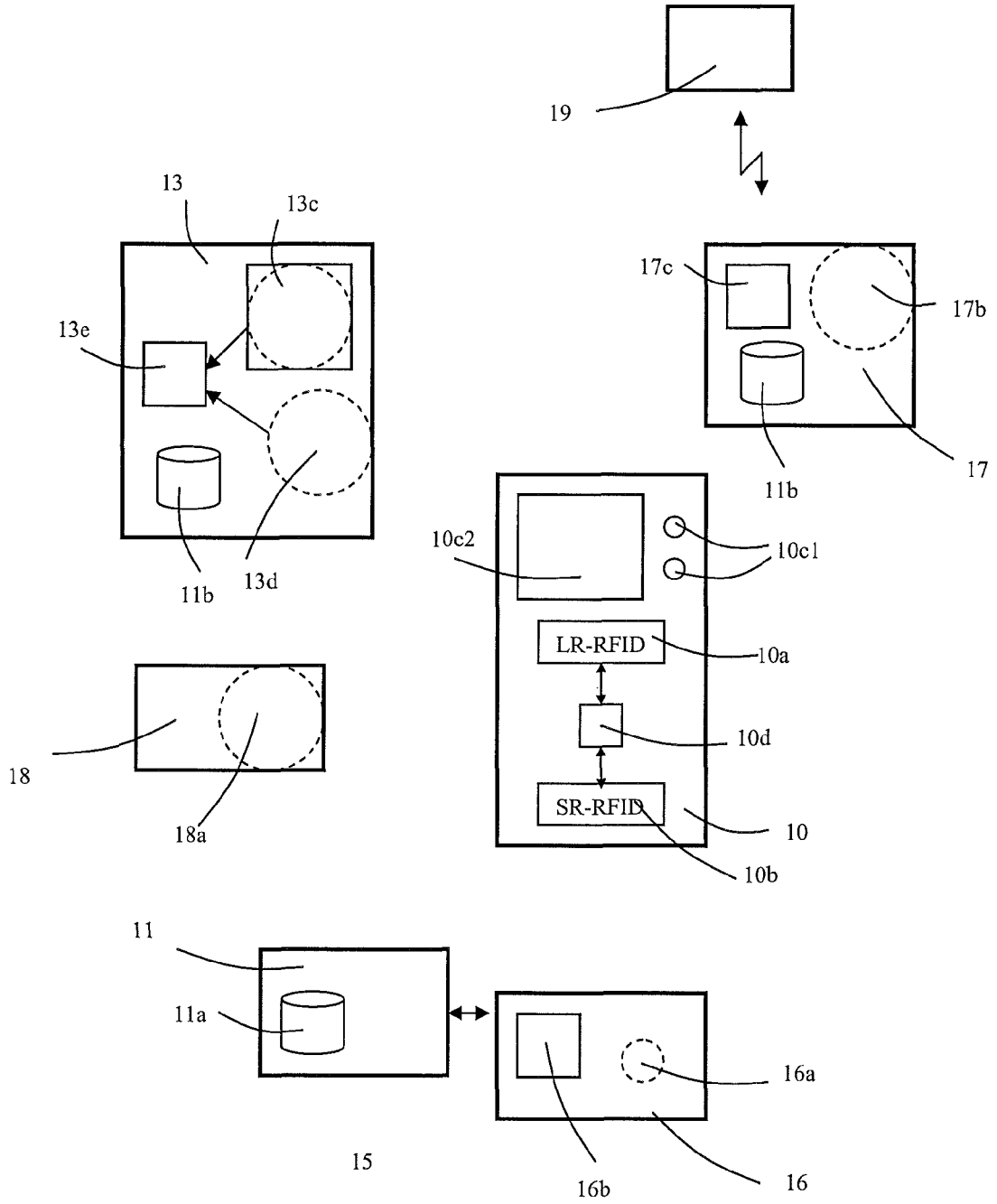

FIG. 2 presents a second system according to the invention.

DETAILED DESCRIPTION OF THE INVENTION

In the following the meaning of certain terms used in this application is explained in more detail:

- identification point: the term refers both to a short-range identification point and to a long-range identification point.
- access right: an access right determines the space or area in a building to which a passenger has a right of entry or it determines a service request which generates a conveying service made to a space or area in the building. A period of validity, within the scope of which an access right can be used, can be connected to an access right.

FIG. 1 illustrates a system according to the invention broken down into operating blocks. Operating block 10 presents a terminal device given into the possession of a passenger, into which device is integrated a long-range identifier 10*a* (LR-RFID), a short-range identifier 10*b* (SR-RFID), and also a user interface 10*c*, which comprises a display element 10*c*2 as well as selection pushbuttons 10*c*1. The identifiers 10*a*, 10*b* are passive or active identifiers based on RFID technology, which identifiers transmit/receive information wirelessly controlled by an external excitation signal. The display element 10*c*2 is e.g. an electronic ink display, which does not consume electric power in a static state, i.e. when the information to be presented on the display element does not change. A memory is marked with the reference number 10*d*, in which memory terminal-specific data is recorded, such as e.g. the individual ID number of a terminal device and the service profile defining the access rights of a terminal device. The memory 10*d* can be integrated into a long-range identifier and/or a short-range identifier and/or a separate memory circuit. Additionally, a terminal device can contain a processor unit (not presented in FIG. 1) for controlling the functions of the terminal device according to the data recorded in the memory. The electric power needed by the components of a terminal device can be produced e.g. with a battery or alternatively by utilizing the induction effect of the excitation signal to be used for reading RFID identifiers. The terminal device is manufactured e.g. on a card-type substrate, into which the components and wiring needed are integrated utilizing electronics printing technology that is per se known in the art, which enables the manufacture of very cheap, even disposable, terminal devices.

Operating block 16 presents an outer door of a building, which door is provided with an electric lock 16*b*. In connection with an outer door is a short-range identification point 16*a*, which comprises a transmitter/receiver unit for recording/reading information in/from the memory 10*d* of a terminal device. The transmitter/receiver unit sends an excitation signal into its surroundings, in response to which signal a short-range identifier 10*b* transmits data to the transmitter/receiver unit or vice versa. The operating area (operating range) of the transmitter/receiver unit is essentially short, e.g. less than 10 cm, in which case the transmission of data can only occur if the user takes his/her terminal device to within aforementioned short range of the short-range identification point.

Operating block 17 presents by way of an example an automatic door separating two different spaces of the building, which door is provided with a locking mechanism 17*c* and in connection with which door is a long-range identification point 17*b*, which monitors the terminal devices in the proximity of the automatic door. Operating block 18, for its part, presents a pass gate, via which people in the building can leave the building but via which there is no access into the building. In connection with the pass gate 18 is a long-range identification point 18*a*, which monitors the terminal devices leaving the building along with passengers. Operating block 13 presents an elevator system, which comprises at least one elevator, the elevator car 13*b* of which comprises a long-range identification point 13*c* and there are also floor-specific long-range identification points 13*d* in the elevator lobbies. The long-range identification point 13*c* monitors the terminal devices entering and leaving an elevator car along with the elevator passengers. The long-range identification points 13*d* monitor the terminal devices of passengers in the elevator lobbies. A control system 13*e* controls the elevators of the elevator system on the basis of the calls given by passengers with their terminal devices. As is seen from FIG. 1, an elevator system does not necessarily need to comprise conventional call-giving appliances based on pushbuttons but instead calls can be given using just terminal devices 10. If necessary, the elevator system can be provided with conventional call-giving appliances, in which case also passengers without a terminal device can use the elevators. In the elevator car there are also detection means for determining the number of passengers in the elevator car. A car load-weighing device, a door photocell, a camera disposed in the elevator car or other corresponding arrangement can be used as the detection means. The elevator system can compare the number of terminal devices detected in an elevator car to the amount of passengers determined by the detection means and prevent the access of people traveling without a terminal device to floors requiring an access permit.

Long-range identification points, likewise to a short-range identification point, comprise a transmitter/receiver unit, which sends an excitation signal into its surroundings, in response to which signal a long-range identifier 10*b* of a terminal device transmits data recorded in the memory of the terminal device to the transmitter/receiver unit or vice versa. The operating area (operating range) of the transmitter/receiver unit is essentially long, preferably a number of meters, in which case reading of data can occur e.g. from a terminal device that is in the pocket of the possessor of the terminal device.

The operating block 11 in FIG. 1 presents a back-end system, in connection with which is a database 11*a* in which service profiles are recorded, in which service profiles the access rights specific to a terminal device, and if necessary other information specific to a terminal device, are recorded. With a service profile the functions of the terminal device can be personalized for a certain purpose or user group, and it can be determined alongside access rights e.g. whether the possessor of a terminal device can give to the elevator system so-called priority calls or other special calls, information about a physical handicap or other disabilities, information about the language used by the user, the default floor on which e.g. the workpoint of the user is located, et cetera. So that the possessor of a terminal device could use his/her terminal device for giving service requests, the access rights of the terminal device must first be activated. For example, when the possessor of a terminal device tries to enter a building in a system according to FIG. 1, he/she takes the terminal device in his/her possession to a short-range identification point 16*a*, which reads the ID number of the terminal device, and transmits it to the back-end system 11. The back-end system identifies the terminal device on the basis of the ID and activates the access rights by performing one or more of the following procedures when the terminal device is in the operating area of the short-range identification point 16*a:*

- the back-end system configures the terminal device by recording a service profile in the memory of the terminal device, in which service profile the access rights of the terminal device are set. This procedure is suited to situations in which a terminal device is "blank", a terminal device is handed over to a new user, or the terminal device has been used in some other building in which a service profile effective in the other building in question has been loaded into a terminal device. A request for a PIN code or other corresponding certificate can be connected to the procedure in order to enhance access control.
- the back-end system updates the access rights of a terminal device by adding/deleting individual access rights to/from the memory of the terminal device. The procedure is suited e.g. to situations in which a person regularly visits a building and his/her access rights only change occasionally.
- the back-end system updates the period of validity connected to one or more access rights. With the procedure temporary access rights can be created, the period of validity of which rights is e.g. limited to certain days of the week and/or to certain times of the day. The criteria, on the basis of which the temporary access rights are created, are recorded e.g. in a service profile. As a result of the procedure access control improves because the access rights of a terminal device must be "renewed" e.g. daily before admitting the user of a terminal device into the building.
- if the back-end system verifies that the access right of the user to a location (in FIG. 1 to the entrance lobby) monitored by a short-range identification point is valid, the back-end system sends an opening command to a locking device (in FIG. 1 the electric lock of an outer door) of a conveying device. After opening of the locking the person can move into the aforementioned location or space in the building and can use his/her terminal device for giving service requests within the scope of the activated access rights.

Transmission of the data connected to the aforementioned activation procedures from/to a terminal device occurs via the short-range identifier 10*b* in the short-range identification point. Since transmission of the data occurs from short range, the hijacking or copying of data is fairly impossible. Access control is also improved by the fact that the checking, and if necessary updating, of access rights in the terminal device, occurs e.g. before the opening of the locking of the outer door, in which case it can be ensured that up-to-date access rights are recorded in a terminal device before a user moves into a building.

When a possessor of a terminal device enters the entrance lobby in the manner described above, he/she can use his/her terminal device for giving service requests connected to a conveying system. Service requests are either service requests automatically generated by a terminal device or service requests based on a selection of the passenger. A terminal device automatically generates a service request when a person, with his/her terminal device, arrives in the operating area of a certain identification point and the access right required by the service request is valid. An optional service request requires a service request selection made by a passenger or an acknowledgement made by a passenger to a service request proposal presented by a terminal device. In this option a passenger uses the selection pushbuttons of a terminal device for giving a service request.

In the following an example of automatic service requests in a system according to FIG. 1 is presented. In this example elevator calls and other service requests are generated automatically without selections made by a passenger for taking a passenger to the default floor indicated by a service profile and for giving access to the office in which his/her workpoint is located. When a passenger comes into an elevator lobby, the long-range identification point 13*d* monitoring the elevator lobby reads the floor number of the default floor recorded in the terminal device of the passenger and checks, if necessary, whether the access right to the default floor recorded in the terminal device is valid. If the access right is valid, the long-range identification point 13*d* sends a landing call to the elevator system for getting an elevator car to the elevator lobby where the passenger is at that time. When the elevator car sent by the elevator system arrives, the doors of the elevator car open and the passenger moves into the elevator car 13*b*. The long-range identification point 13*c* in the elevator car reads the default floor recorded in the terminal device and sends a floor call to the elevator system for driving the elevator car to the aforementioned default floor. When the elevator car has arrived at the default floor, the passenger moves from the elevator car to the automatic door 17 leading to the office, and the long-range identification point 17*b* at which automatic door detects the terminal device of the passenger and checks whether the access right that is needed for opening the door 17 and that is recorded in the terminal device is valid. If the access right is valid, the long-range identification point 17*b* sends an opening command to the locking mechanism 17*c* of the door for admitting the passenger into the office.

In the following an example of optional service requests in a system according to FIG. 1 is presented. When a passenger comes into an elevator lobby and reaches the operating area of a long-range identification point 13*d*, a list of the floors to which the possessor of the terminal device has an access right is generated on the display 10*c*2 of the terminal device. The passenger chooses the destination floor he/she wants from the list using the selection pushbuttons 10*c*1 of the terminal device. The identification point 13*d* receives from the terminal device information about the destination floor selected by the passenger and sends a destination call according to the selection to the elevator system. The elevator system allocates an elevator car for the use of the passenger, which elevator car is notified e.g. on a display 10*c*2 of the terminal device. After the allocated elevator car has arrived, the passenger moves into the elevator car, which takes him/her to the selected destination floor.

The selection list to be presented on the display of a terminal device is generated either by the terminal device itself or the list is loaded into a terminal device from a long-range identification point. In the first-mentioned alternative the identification point sends e.g. its own identifier code (the ID of the identification point) or a code identifying the elevator system (the ID of the conveying device) to a terminal device, on the basis of which code, as well as on the basis of the access rights connected to the elevator system and recorded in the terminal device, the terminal device forms the aforementioned selection list for the display 10*c*2. In the latter alternative a long-range identification point reads the access rights recorded in a terminal device, forms the aforementioned selection list on the basis of them and sends it to the terminal device for presenting on the display 10*c*2.

One task of the back-end system 11 is to receive control data connected to terminal devices from identification points, which control data it records in a log file 11*b*. On the basis of the control data the back-end system has up-to-date information about in which part/space of the building each user of a terminal device is at any time, when he/she went there, when he/she left there, and/or to where he/she is going on the basis of the latest service request. If the back-end system detects inconsistencies in the control data, it sends alarm data to the control center 19. An inconsistency can arise e.g. if two terminal devices that have the same ID are detected in the building or e.g. if a terminal device with a certain ID generates an elevator call from a floor that is a different floor to which the possessor of the terminal device traveled on the basis of earlier control data. On the basis of control data it can also be deduced whether a passenger deviates from the route required by the service request given by him/her, e.g. will he/she leave the elevator car on another floor than the floor to which he/she is traveling on the basis of the call he/she gave. Control data can alternatively be recorded in identification points and/or in conveying devices that are in connection with identification points. In this case each identification point and/or conveying device independently monitors for inconsistencies in control data that is collected from terminal devices detected in the operating area of the identification point. If an identification point detects inconsistencies in the control data it collects, it can generate alarm data, which is transmitted, e.g. wirelessly, to a control center 19 and/or is expressed by signaling means in connection with the identification point. Correspondingly, if, for example, the elevator system detects inconsistencies in the control data it collects, it sends alarm data e.g. to a reception desk in the entrance lobby and performs a run operation that automatically takes the passenger that caused the alarm to the entrance lobby. On the basis of control data conclusions can also be drawn about the magnitudes and directions of traffic flows in the different parts of a building on different days of the week and/or at different times of the day, and the information can be used e.g. for predictive control of the conveying devices.

When a passenger wants to leave the building, he/she goes to the entrance lobby and exits the building via a pass gate 18. The long-range identification point 18*a* in connection with the pass gate detects the terminal device of the passenger, in which case the access rights of the terminal device are passivated e.g. by setting the period of validity connected to the access rights to "zero" or by deleting all, or at least a part of, the access rights recorded in the terminal device. So that the passenger could use his/her terminal device after this, he/she must take the terminal device again to a short-range identification point 16, where the passivated access rights are reactivated. If there are a number of exit routes in a building, they are all provided with an identification point 18, in which the access rights of a terminal device can be passivated.

In the system according to FIG. 1 the back-end system is connected to identification points and to the conveying devices in connection with them with a data transfer connection 12, via which the back-end system can receive control data connected to the terminal devices and can also transmit service requests or other control commands to the conveying devices in connection with the identification points. FIG. 2 illustrates one second system according to the invention, in which system the back-end system 11 is integrated into connection with a short-range identification point 16 and it does not have a connection to any other identification points or to conveying devices in connection with them. Activation of the access rights of terminal devices takes place in a short-range identification point 16, as described in connection with FIG. 1. Since the back-end system is not connected to any other identification points, the collection and analysis of control data occurs independently in the identification points or in the conveying devices of the conveying system. One advantage of the solution is that an access control solution that is simple and easily maintained is obtained from the system.

The system according to the invention can also be utilized in exceptional situations, in which a building, or a part of a building, must be evacuated. If e.g. a fire is detected in the building, personal guidance and/or instructions on how to act relating to evacuation is/are sent to all the terminal devices of people in a danger zone, depending on which part of the building the person (terminal device) is at the time of the incident. Since it can be assumed that almost all the people in the building have a terminal device 10, personal guidance connected to an evacuation is delivered to its destination reliably and quickly.

Although the invention is described above using elevator systems as examples, it is obvious to the person skilled in the art that different embodiments of the invention are not only limited to the examples described above, but that they may be varied within the scope of the claims presented below. Thus the terminal device can be e.g. a disposable terminal device, the access rights of which are activated before handing over to a passenger e.g. at a reception desk of a building, to where the passenger can also return his/her terminal device after use.

The invention claimed is:

1. A method for limiting access rights in a building, the building including a conveying system and an access control system connected to the conveying system, the access control system including at least one short-range identification point, at least one long-range identification point and a terminal device for passengers, the terminal device being configured to generate service requests for the conveying system, the method comprising:

moving the terminal device into an operating area of the at least one short-range identification point;

activating the access rights connected to the service requests of the terminal device in the operating area of the at least one short-range identification point;

moving the terminal device into an operating area of the at least one long-range identification point;

generating, by the terminal device, at least one of the service requests; and transmitting, by the terminal device while the terminal device is in the operating area of the at least one long-range identification point, the at least one generated service request to the conveying system if at least one of the access rights connected to the at least one generated service request is valid, the validity being determined on the basis of the activating.

2. The method according to claim 1, wherein the activating includes at least one of:

recording a service profile the terminal device, the service profile including the access rights of the terminal device;

updating the access rights recorded in the terminal device by at least one of adding and deleting access rights;

updating the period of validity connected to one or more of the access rights;

unlocking a conveying device in connection with the at least one short-range identification point if the access right is valid.

3. The method according to claim 1, wherein the activating activates access rights for specific short-range identification points.

4. The method according to claim 1 above, further comprising:

configuring a user interface of the terminal device on the basis of currently valid access rights of the terminal device.

5. The method according to claim 1 above, further comprising:

configuring a user interface of the terminal device based on a location of the terminal device.

6. The method according to claim 1 above, further comprising:

monitoring a position of the terminal device in one or more identification points in the building;

generating at least one of guidance data and alarm data if the monitoring indicates that the terminal device deviates from a route associated with the at least one generated service request.

7. The method according to claim 1 above, further comprising:

collecting control data connected to the terminal device in at least one identification point; and at least one of generating alarm data and performing a control procedure connected to the conveying system if inconsistencies are detected in the collected control data.

8. The method according to claim 1 above, further comprising:

monitoring an exit of the terminal device from a set monitoring area in at least one identification point;

deactivating at least a part of the access rights of the terminal device if the monitoring indicates that the terminal device leaves the monitoring area.

9. The method according to claim 1 above, further comprising:

independently checking the access right connected to the at least one generated service request in an identification point.

10. A system for limiting access rights in a building, wherein the system comprises:

a conveying system including one or more conveying devices;

an access control system connected to the conveying system, the access control system including at least one short-range identification point, at least one long-range identification point, and a back-end system connected to the at least one short-range identification point; and a terminal device for a passenger, the terminal device including, at least one short-range identifier configured to transmit data between the terminal device and the at least one short-range identification point, and at least one long-range identifier configured to transmit data between the terminal device and the at least one long-range identification point, wherein the access control system is configured, to activate the access rights connected to service requests of the terminal device in the operating area of the at least one short-range identification point, and wherein the terminal device is configured to, to generate the service requests, and to transmit at least one of generated the service requests to the conveying system while the terminal device is in the operating area of the at least one long-range identification point if the access right connected to the at least one generated service request is valid, the validity being determined on the basis of the activation.

11. The system according to claim 10, wherein the access control system is configured to perform at least one of:

recording a service profile in the terminal device, the service profile including at least the access rights of the terminal device;

updating the access rights recorded in terminal device by at least one of adding and deleting access rights;

updating the period of validity connected to one or more access rights;

opening a conveying device in connection with the at least one short-range identification point if the access right is valid.

12. The system according to claim 10, wherein the access control system is configured to activate access rights for specific short-range identification points.

13. The system according to claim 10, wherein the access control system is configured to configure a user interface of the terminal device on the basis of the currently valid access rights of the terminal device.

14. The system according to claim 10, wherein the access control system is configured to configure a user interface of the terminal device based on a location of the terminal device.

15. The system according to claim 10, wherein the access control system is configured to monitor a position of the terminal device in the building, and to generate at least one of guidance data alarm data if the monitoring indicates that the terminal device deviates from a route associated with the at least one generated service request.

16. The system according to claim 10, wherein access control the system is configured to collect control data connected to the terminal device in at least one identification point, to analyze the collected control data, and to at least one of generate alarm data and perform a control procedure connected to the conveying system if the analysis detects inconsistencies in the collected control data.

17. The system according to claim 10, wherein the access control system is configured to monitor, in at least one identification point, an exit of the terminal device from a set monitoring area, and to deactivate at least a part of the access rights of the terminal device if the monitoring indicates that the terminal device leaves the monitoring area.

18. The system according to claim 10, wherein at least one identification point is configured to independently check the access rights connected to the service requests.

19. The system according to claim 10, wherein the conveying system comprises an elevator system, the elevator system being configured to receive elevator calls based on the service requests from the terminal device.

* * * * *